US006626368B2

(12) United States Patent
Nakayama et al.

(10) Patent No.: US 6,626,368 B2
(45) Date of Patent: Sep. 30, 2003

(54) WATER VEIL DEVICE

(75) Inventors: Yasuki Nakayama, 3-56-2 Higashi-Oizumi Nerima-ku, Tokyo 178-0063 (JP); Minoru Ueno, Tokyo (JP)

(73) Assignees: Yasuki Nakayama, Tokyo (JP); Japan Photonics, Inc., Tokyo (JP)

( * ) Notice: Subject to any disclaimer, the term of this patent is extended or adjusted under 35 U.S.C. 154(b) by 155 days.

(21) Appl. No.: 09/924,031

(22) Filed: Aug. 7, 2001

(65) Prior Publication Data

US 2002/0040938 A1 Apr. 11, 2002

(30) Foreign Application Priority Data

Aug. 9, 2000 (JP) ..... 2000-241150

(51) Int. Cl.[7] ..... B05B 17/08

(52) U.S. Cl. ..... 239/22; 239/16; 239/17; 239/20; 239/23; 239/71; 239/601

(58) Field of Search ..... 239/16, 17, 20, 239/22, 23, 71, 502, 503, 504, 505, 513, 518, 519, 523, 589, 601

(56) References Cited

U.S. PATENT DOCUMENTS 3,292,861 A * 12/1966 Kawamura et al. ..... 239/17
3,785,559 A * 1/1974 Hruby, Jr. ..... 239/17
4,688,720 A * 8/1987 MacDonald et al. ..... 239/17
5,067,653 A * 11/1991 Araki et al. ..... 239/18
5,445,322 A * 8/1995 Formhals et al. ..... 239/18
5,899,634 A * 5/1999 Lochtefeld ..... 239/17
6,250,570 B1 * 6/2001 Starr et al. ..... 239/17

* cited by examiner

*Primary Examiner*—Robin O. Evans
(74) *Attorney, Agent, or Firm*—Amin & Turocy, LLP

(57) ABSTRACT

The present invention provides a device where the liquid film changes into many kinds of shapes and furthermore these shapes can change according to the changes of outside factors including the sound and light etc. Liquid is forced through a flow path by controlling an outlet velocity $u_0$ that is an initial value of liquid velocity u according to equation (1) in which supply pressure p of liquid is varied by a numerically controlled device $$\frac{2T}{r_c} + \frac{2T\cos\phi}{x} - p + g\rho t\sin\phi - \frac{u^2\rho t}{r_c} = 0 \quad (1)$$

wherein $\phi$ is an inclination angle of the water veil surface to the vertical axis, T is the surface tension of the liquid, t is the thickness of the water veil at an arbitrary point, $r_c$ is the radius of curvature, and g is gravitational force.

17 Claims, 5 Drawing Sheets

WATER VEIL DEVICE

TECHNICAL FIELD

The technical field of this invention relates to the water veil device that can be utilized as a healing device for relaxation, as a domestic decorative device and as a exterior device in gardening.

BACKGROUND OF THE INVENTION

Conventional water devices consist of a double disk nozzle (see FIG. 8*a*) and a control valve (see FIG. 8*b*), in which a pressurized liquid is supplied from the center and is jetted out from a gap between two disks. These devices control the liquid flow by the outlet port of a pneumatic micrometer, a nozzle-flapper mechanism and a conical valve etc. These devices are the liquid control devices but not the devices to produce the film of liquid. Furthermore, these devices cannot make the liquid thin film of a ball shape and a temple bell shape, etc.

The applicants of this matter offer the device of making a thin film of liquid (Japanese Patent No.2677772) and the film is thin enough to appear like a transparent film.

SUMMARY OF THE INVENTION

The present invention provides a device where the liquid film changes into many kinds of shapes and furthermore these shapes can change according to the changes of outside factors including the sound and light etc. The water veil device of this invention is designed to supply a relaxed pleasant space to people and in effect to heal the mind of people.

The water veil device of the present invention supplies a relaxed pleasant space to people in the following manner. The water veil device produces a fountain of liquid, which features jetting out liquid as a thin film by changing the cross-section of the water path as linear or smoothly decreasing curves and by controlling the outlet velocity $u_0$ that is the initial value of the liquid velocity u according to the following equation (1) in which the supply pressure of liquid is varied by a numerically controlled device. Another feature of this water veil device is that it produces water veils of an onion shape, a rugby ball shape, a temple bell shape and a ball shape in order by increasing the supply pressure from a minimum value.

$$\frac{2T}{r_c} + \frac{2T\cos\phi}{x} - p + g\rho t\sin\phi - \frac{u^2\rho t}{r_c} = 0 \quad (1)$$

The device makes it possible to reverse the order of changes of the water veil shapes to the order of a ball shape, a temple bell shape, a rugby ball shape and an onion shape by decreasing the supply liquid pressure from a maximum value.

By adjusting the supply pressure to the change of the outside factors detected by sensors, the shape of water veil changes appear as if the veil is dancing.

The supply pressure of water veil is changed by controlling the supply voltage or the frequency of power source of the motor for pumping water of this device.

Furthermore, the method to change the above-mentioned supply pressure includes a technique of varying the cross-section of the water path by moving one of the sidewalls of the double curved disks relative to the other.

Figure 1:
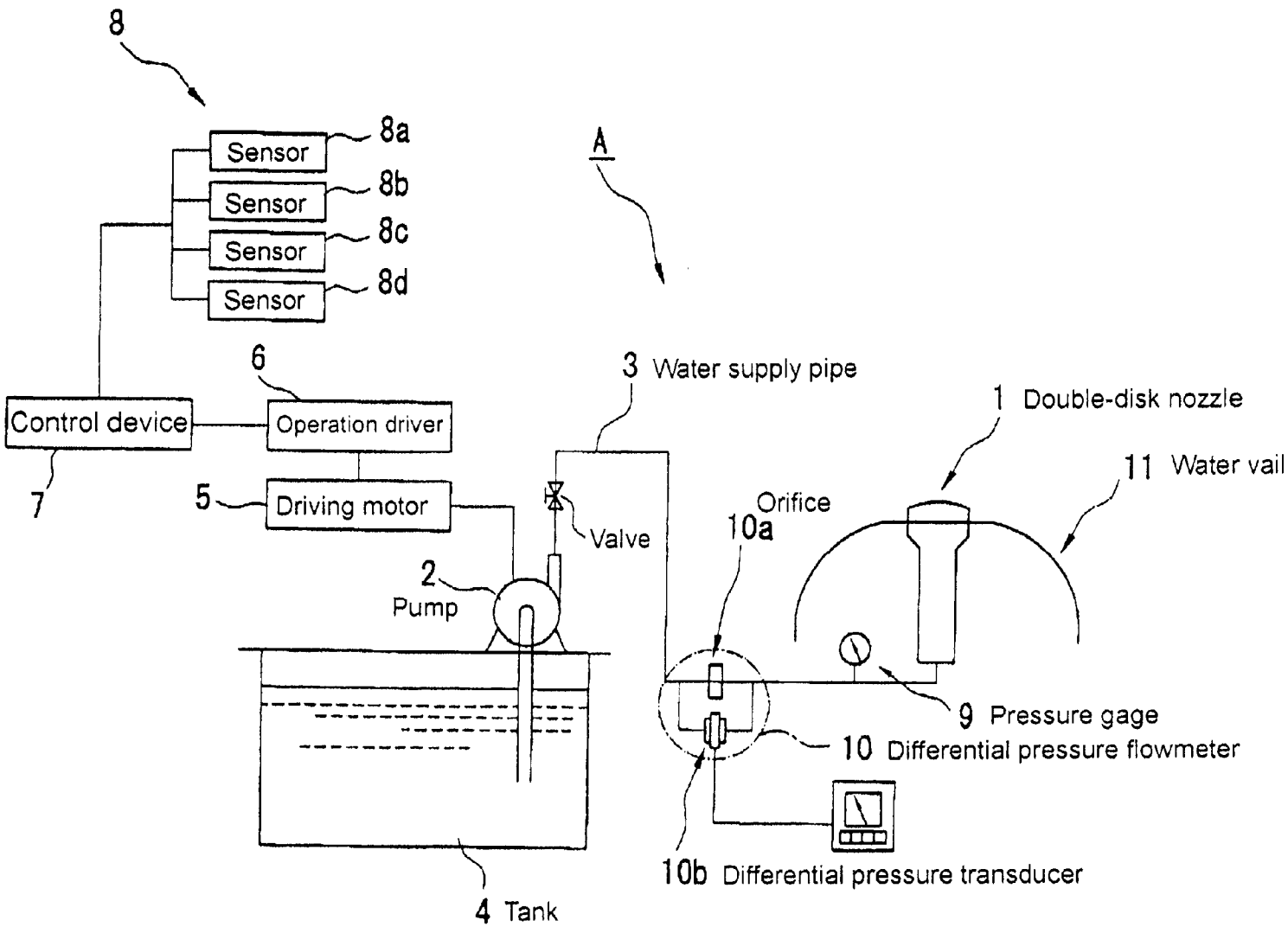
FIG. 1 is an outline construction diagram of the water veil device A showing one aspect of this invention.

The numerical identifiers in the drawings are as follows: 1 Double-disk nozzle, 2 pump, 3 Water supply pump, 4 Tank, 5 Driving motor, 6 Operation driver, 7 Control device, 8 Sensor, 9 Pressure gauge, 9 Differential pressure flowmeter, 10*a* Orifice, 10*b* differential pressure transducer, 11 Water veil, 12 Core, 12*a* Outside wall surface, 13 Conduct pipe, 13*a* Inside wall surface, and 14 jet out port.

DETAILED DESCRIPTION OF THE INVENTION

According to the water veil device of this invention, the shape of water veil changes, for example, between several kinds of shapes such as from an onion shape to a rugby ball shape, a temple bell shape and a ball shape in order by increasing the supply pressure from a minimum value, and inversely from a ball shape to a temple bell shape, a rugby ball shape and an onion shape in order by decreasing the supply pressure from a maximum value. These changes appear as if the water veil is dancing according the outside factors of music melody etc. By adding sound, smell and color to this device, the surrounding people are invited to a world of fantasy as their minds relax in response to the water veil.

By adjusting the supply pressure to the change of the outside factors detected by sensors, including for example, the changes in the modulation and amplitude of sound, the changes in amplitude and frequency of light, the changes in temperature and the changes in the magnetic field, the shape of water veil changes as an onion shape, a rugby ball shape, a temple bell shape and a ball shape.

Because the water veil changes as if it is dancing, human interests and tastes are satisfied. This device may be employed as fountain equipment suitable as an interior or entrance hall decoration, a decoration in conference or society room table and a central facility of rest and relaxation places in gardens.

There are many different methods to change the supply liquid pressure. For example, a simple method is control the voltage or the frequency of power supply to the motor for pumping water of this device. The shape of water veil can also be varied accurately in an instant of time by moving one of the side walls of the double curved disks relative to the other, and hence changing the cross-section of the flow path. The flow path may be curvilinear.

Now, the water veil device 1 in a first aspect of this invention is explained with reference to the figures. As shown in FIG. 1, the water veil device A comprises the double-disk nozzle 1, the water supply pipe 3 of one side connected to the nozzle 1 and the other side to the liquid supply pump 2, the tank 4 from which the pump 2 pumps up the liquid, the motor 5 for driving the pump 2, the operation driver 6 for driving the motor 5 and the control device 7 having a CPU, and the sensors 8 connected electrically to the control device 7. The orifice of the double disk nozzle 1 may be curvilinear in shape.

In FIG. 1, the pressure gauge 9, the differential pressure flow-meter 10 comprises the orifice 10*a* and the differential pressure transducer 10*b* are equipped to test the relation between the supply pressure P and the shape of the water veil 11. For the water veil device as a product, these components are optional and are not indispensable components.

Figure 2:
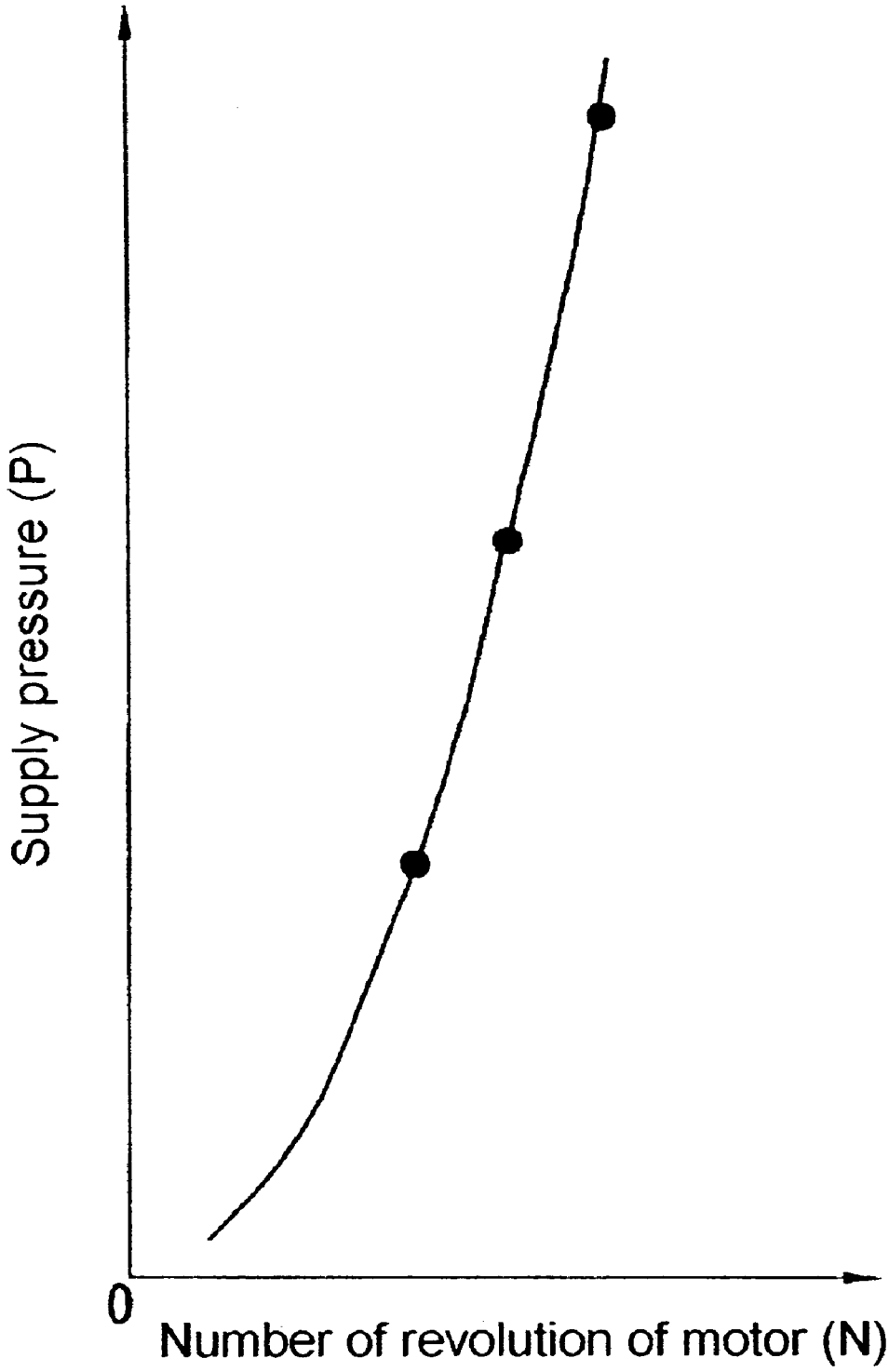
FIG. 2 is an explanation diagram showing the relationship between the number of revolutions of driving motor and the supply pressure in the water veil device A in one aspect of this invention.

In this first aspect of the invention, the supply liquid pressure P is increased or decreased as shown in FIG. 2 by controlling the control device 7, the supply voltage or frequency of power source of the motor 5 for pumping the water of this water veil device A.

Figure 3:
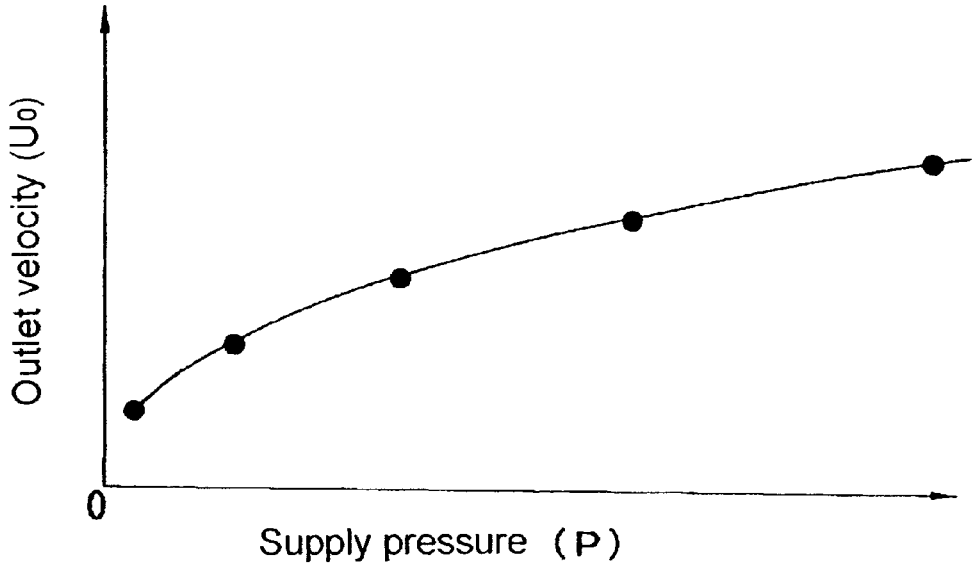
FIG. 3 is an explanation diagram showing the relationship between the supply pressure P and the outlet velocity in the water veil device A according to one aspect of this invention.

As the liquid supply pressure P is increased or decreased, the outlet velocity $u_0$ of water etted out from the outlet port of nozzle 1 increases or decreases as shown in FIG. 3.

Figure 4:
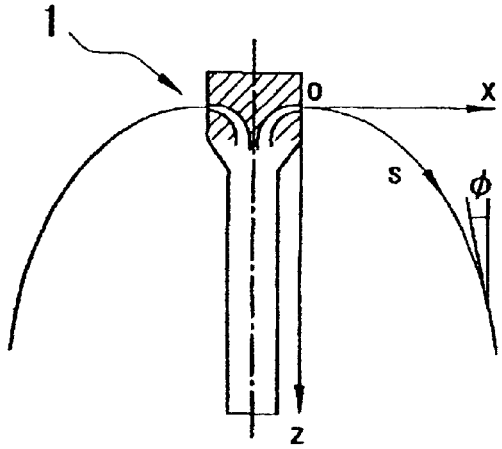
FIG. 4 is an explanation diagram showing the coordinate axis to make numerical simulation in the water veil device according to one aspect of this invention.
Figure 5:
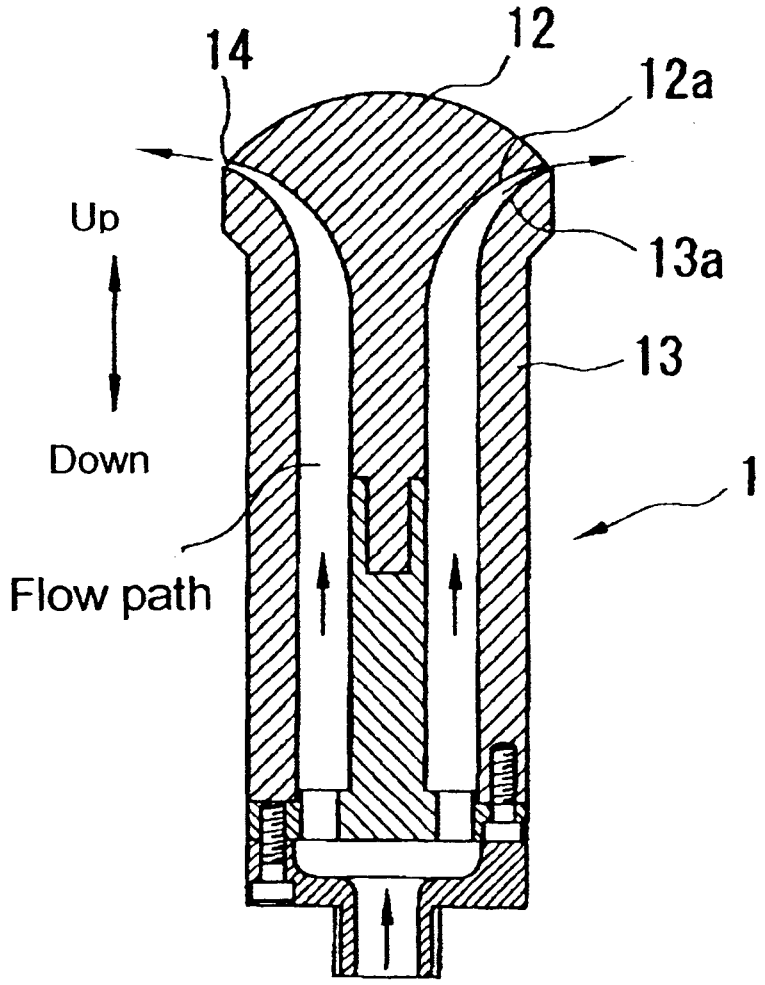
FIG. 5 is a vertical sectional diagram of nozzle in the water veil device according to one aspect of this invention.

As shown in FIGS. 4 and 5, the outlet point of double-disk nozzle 1 is taken as the origin of the coordinate axes. The vertical axis is the z-axis (positive in downward direction) and the horizontal axis is the x-axis. The parameter T denotes the surface tension, p the pressure difference between inside and outside of water veil, Q the flow quantity, $u_0$ the outlet velocity from the nozzle, and g the gravitational acceleration.

Now, considering the surface tension T is constant, and neglecting the air resistance, the velocity of water u at an arbitrary position is given by equation (2), $$u^2=u_0^2+2\,g\,z \tag{2}$$

Putting the inclination angle of the water veil surface to the vertical axis as $\phi$, the thickness of water veil at an arbitrary point as t and the radius of curvature as $r_c$ the following equation is obtained from balancing the surface tension, pressure, gravitational force and inertia force:

$$\frac{2T}{r_c}+\frac{2T\cos\phi}{x}-p+g\rho t\sin\phi-\frac{u^2\rho t}{r_c}=0 \tag{1}$$

Continuity equation is given as, $$2\pi\times ut=Q$$

Figure 6:
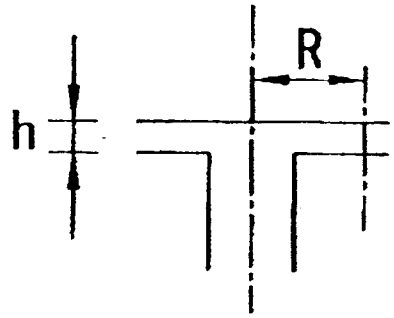
FIG. 6 is an explanation diagram showing the sectional area of the flow path of the nozzle according to one aspect of this invention.
Figure 7:
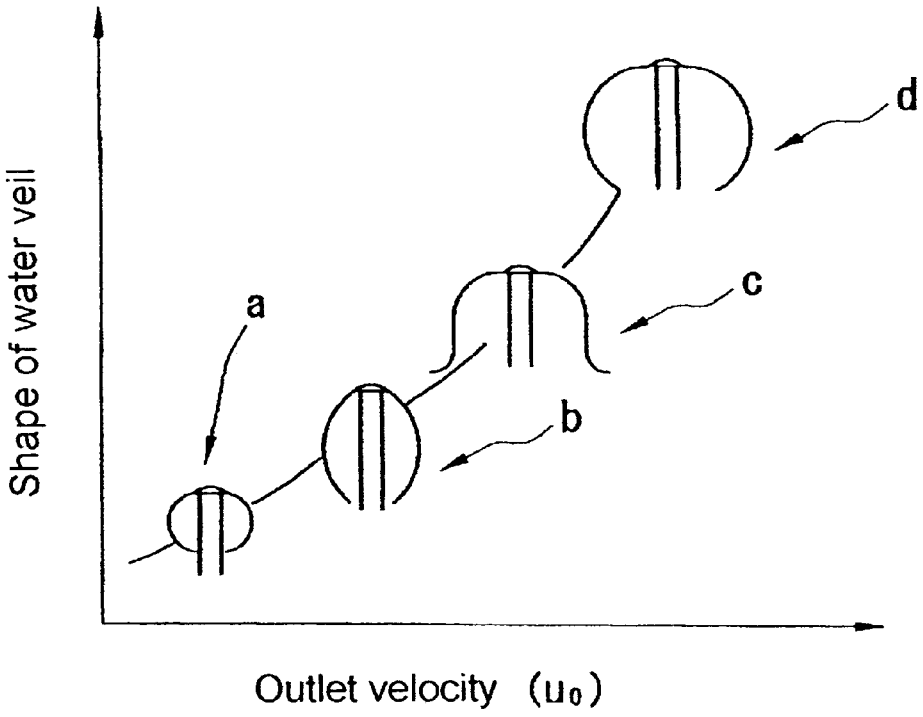
FIG. 7 is an explanation diagram showing the relationship of the supply pressure of the liquid and the shape of the water veil in one aspect of the water veil device of this invention.
Figure 8:
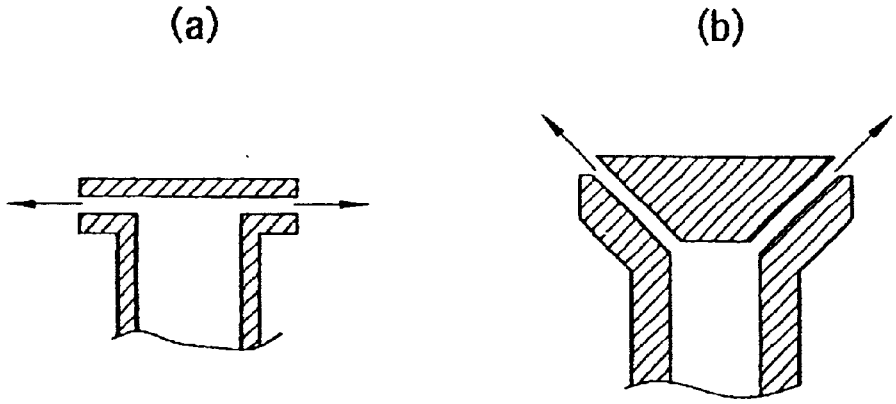
FIG. 8 is a vertical sectional diagram of conventional nozzles (a) and (b) in conventional water devices.

The water veil device A jets out liquid in the state of a thin film by making the change of the cross-section (=2πR h: R is the optional radius of the double-disk nozzle, h is the clearance, refer to FIG. 6) of the water path as a linearly or smoothly decreasing curve. In this device, the outlet velocity $u_0$ from the nozzle is controlled numerically by the control device 7 and as shown in FIG. 7, so that, for example, the shape of water veil 11 can be varied from an onion shape to a rugby ball shape, a temple bell shape and a ball shape in order by increasing the supply pressure from a minimum value. The name of each shape of water veil 11 is given for convenience, so other names to represent the each shape of water veil as shown in FIG. 7 can be used.

The shape of water veil 11 changes reversibly from a ball shape to a temple bell shape, a rugby ball shape and an onion shape in any order by decreasing the supply pressure from a maximum value. As mentioned above, the water veil device A of this invention can change the shape of the water veil 11 continuously and reversibly.

Furthermore, for the water veil device A of this invention, the supply pressure changes according to the outside factors detected by sensors. Here, the outside factors mean, for example, the modulation and amplitude of sound, the amplitude and frequency of light, the changes in temperature and the changes in the magnetic field, etc.

As shown in FIG. 1, for example, the sensor 8 to detect the outside factors consists of a sensor 8*a* that changes the modulation and amplitude of sound to the electric current, a sensor 8*b* as a light-detecting sensor or a opto-electronic sensor that changes the amplitude of light to the digital electric signal, a sensor 8*c* that changes the color frequency of light to the digital signal, an infra-red sensor that coverts the temperature changes to the changes in electrical current and the magnetic sensor that detects magnetic change, though not illustrated in this figure, etc.

The output signals from any one or plural number of above-mentioned sensors of the sensor 8 are fed into the control device 7 and the number of revolution of the driving motor is changed according to the degree of change of the outside factors. The output velocity of the liquid $u_0$ is then varied as shown in FIG. 2 and FIG. 3 by increasing or decreasing the supply pressure of liquid P and therefore the shape of water veil 11 is varied continuously and reversibly as shown in FIG. 11.

Thus, if the melody of a song is detected, for example, by the sensor 8 around of the fountain device A, the water veil 11 of the fountain device is observed as if it is dancing to the change of the melody. Moreover, if the values of the outside factors, such as darkness or brightness of light surrounding the water veil device A, the temperature increase or decrease, the magnetic field moving toward or away from the sensor, etc. exceed certain constant values (electrical threshold values or mechanically set up values), the shape of the water veil changes appearing just like dancing according to the degree of the outside factors.

Another aspect of this invention is the method of changing the output velocity $u_0$, in the nozzle 1. As shown in FIG. 5, the output velocity is varied by changing the cross-section of the flow path of the jet out port 14 (circumference×gap) consisting of the outside wall surface 12*a* of the core and the inside wall surface 13*a*. The change in the cross-section is made by moving either the core 12 or the trumpet-shaped conduct pipe 13 in the upward and downward directions.

The means of moving either the above-mentioned core 12 or the conduct pipe 13 in the upward and downward directions utilizes the already known methods of relative motion. For example, the core 12 or the conduct pipe 13 is moved relative to the other by rotating one of them around the nozzle axis using the screw pair. Alternatively, the core 12 or the conduct pipe 13 is slid by the rod with the air cylinder, etc. as a driving source.

By changing slightly the cross-section of the flow path of the jet out port, the supply pressure of liquid P varies, the output velocity $u_0$ changes, and thus the shape of water veil 11 varies continuously and reversibly appearing as if dancing as shown in FIG. 7.

Besides, of course, the condition to produce a thin water film is that the above-mentioned cross-section of the flow path changes in the range of linearly or smoothly decreasing curves.

Moreover, music boxes and light-emitting diodes of red or green, etc. are placed inside and/or outside of the water veil or in the water veil stand. By driving the control device 7 matching to the rhythmical operation of these devices, the shape of the water veil is made to change so that it appears as if it were dancing. In this way, the device becomes a very pleasant decorative article, etc.

As mentioned above, the water veil device jets out liquid as a thin film by changing the cross-section of the flow path to the jet out port to become a linearly or smoothly decreasing curve. The output velocity $u_0$ that is the initial velocity of u is controlled numerically by the supply liquid pressure according to the following equation.

$$\frac{2T}{r_c} + \frac{2T\cos\phi}{x} - p + g\rho t\sin\phi - \frac{u^2\rho t}{r_c} = 0 \quad (1)$$

The shape of water veil 11 changes from an onion shape to a rugby ball shape, a temple bell shape and a ball shape in order by increasing the supply pressure from a minimum value. Hence, the water veil of a thin film appears as if it were dancing and it provides an effective means of satisfying human taste as a decoration.

In addition, it is possible to reverse the order of change fro to a ball shape, a temple bell shape, a rugby ball shape and an onion shape in the reverse order by decreasing the supply pressure from a maximum value. Thus, the water veil has the excellent effect to change the shape of the thin film continuously and reversibly.

By changing the above mentioned supply pressure according to the outside factors detected by the sensor, the shape of water veil changes as if it were dancing. Hence, it satisfies human taste and expectation, relaxes people and the effect of healing is expected. Furthermore, the water veil device responds to clapping and calling sounds by changing the shape of the water veil, and therefore it provides friendliness and increases the effect of healing.

When the supply pressure is varied by controlling the electric source voltage or frequency of the motor driving the pump of the waster veil device, the water veil device becomes a simple device to satisfy human taste. Moreover, when the supply pressure is changed by moving one of the side walls of the double curved disks relative to the other and changing the cross-section of the water path, it has an excellent effect of changing the shape of water veil accurately in an instance of time.

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A water veil device for jetting out liquid as a thin film in a shape by changing the cross-section of a flow path as linear or smoothly decreasing curves and by controlling an outlet velocity $u_0$ that is an initial value of liquid velocity u according to equation (1) in which supply pressure p of liquid is varied by a numerically controlled device $$\frac{2T}{r_c} + \frac{2T\cos\phi}{x} - p + g\rho t\sin\phi - \frac{u^2\rho t}{r_c} = 0 \quad (1)$$

wherein $\phi$ is an inclination angle of the water veil surface to the vertical axis, T is the surface tension of the liquid, t is the thickness of the water veil at an arbitrary point, $r_c$ is the radius of curvature, and g is gravitational force.

2. The water veil device according to claim 1, wherein the shape is selected from one of a ball shape, a temple bell shape, a rugby ball shape and an onion shape.

3. The water veil device according to claim 1, further comprising sensor for detecting outside factors and a control device for varying the pressure, the sensor electrically connected to the control device.

4. The water veil device according to claim 2, further comprising sensor for detecting outside factors and a control device for varying the pressure, the sensor electrically connected to the control device.

5. The water veil device according to claim 3, further comprising a power source connected to a motor for pumping water, wherein the pressure is varied by controlling a supply voltage to the power source.

6. The water veil device according to claim 4, further comprising a power source connected to a motor for pumping water, wherein the pressure is varied by controlling a supply voltage to the power source.

7. The water veil device according to claim 1, further comprising a nozzle with double curved disks each having side walls, wherein liquid pressure is changed by changing a cross-section of a water path by moving one side wall relative to the other.

8. The water veil device according to claim 1, wherein a double curved disk nozzle comprises a curvilinear water path.

9. A method of forming a water veil having a shape, comprising forcing liquid through a curvilinear flow path by controlling an outlet velocity $u_0$ that is an initial value of liquid velocity u according to equation (1) in which supply pressure p of liquid is varied by a numerically controlled device $$\frac{2T}{r_c} + \frac{2T\cos\phi}{x} - p + g\rho t\sin\phi - \frac{u^2\rho t}{r_c} = 0 \quad (1)$$

wherein $\phi$ is an inclination angle of the water veil surface to the vertical axis, T is the surface tension of the liquid, t is the thickness of the water veil at an arbitrary point, $r_c$ is the radius of curvature, and g is gravitational force.

10. The method according to claim 9, comprising changing the shape of the water veil from an onion shape to a rugby ball shape, to a temple bell shape and then to a ball shape by increasing the supply pressure from a minimum value.

11. The method according to claim 9, comprising changing the shape of the water veil from a ball shape to a temple bell shape, to a rugby ball shape and then to an onion shape in order by decreasing the supply pressure from a maximum value.

12. The method according to claim 9, comprising changing the water veil shape as if the veil is dancing, by varying the supply liquid pressure according to changes of an outside factor detected by a sensor.

13. The method according to claim 9, comprising changing the supply liquid pressure by controlling supply voltage or frequency of a power source of a motor for pumping water.

14. The method according to claim 9, wherein the shape of the water veil is a ball shape.

15. The method according to claim 9, wherein the shape of the water veil is a temple bell shape.

16. The method according to claim 9, wherein the shape of the water veil is a rugby ball shape.

17. The method according to claim 9, wherein the shape of the water veil is an onion shape.

* * * * *